United States Patent [19]

Diffrient

[11] Patent Number: 4,624,083

[45] Date of Patent: Nov. 25, 1986

[54] SCREEN SYSTEM FOR OFFICES AND METHOD OF MAKING AND INSTALLING SAME

[75] Inventor: Niels Diffrient, Ridgefield, Conn.

[73] Assignee: Hauserman, Inc., Cleveland, Ohio

[21] Appl. No.: 558,202

[22] Filed: Dec. 5, 1983

[51] Int. Cl.[4] ..... E04B 2/82; E05D 1/04

[52] U.S. Cl. ..... 52/65; 52/70; 52/239; 16/354; 160/351

[58] Field of Search ..... 52/239, 238.1, 241, 52/70, 71, 36, 242, 65; 160/135, 351; 16/354, 386; 74/439, 450, 451

[56] References Cited

U.S. PATENT DOCUMENTS

| | | | |
|---|---|---|---|
| 1,698,136 | 1/1929 | Lawrence | 16/354 |
| 1,877,846 | 9/1932 | Getz | 16/354 |
| 2,111,088 | 3/1938 | Byers | 74/451 |
| 4,020,604 | 5/1977 | Legler et al. | 52/70 X |
| 4,056,985 | 11/1977 | Worrallo | 16/354 X |
| 4,121,645 | 10/1978 | Behr | 160/135 |
| 4,158,936 | 6/1979 | Fulton | 160/135 X |
| 4,213,493 | 6/1980 | Haworth | 160/351 |
| 4,263,761 | 4/1981 | Kristoff | 160/351 X |
| 4,443,911 | 4/1984 | Bannister | 52/239 X |

FOREIGN PATENT DOCUMENTS

| | | | |
|---|---|---|---|
| 859090 | 12/1940 | France | 16/354 |
| 1542244 | 3/1979 | United Kingdom | 52/239 |

*Primary Examiner*—John E. Murtagh
*Assistant Examiner*—Richard Chilcot
*Attorney, Agent, or Firm*—Renner, Otto, Boisselle & Lyon

[57] ABSTRACT

A sound and visual partition screen panel utilizes a treated corrugated cardboard septum to which is secured a frame. Acoustic insulation pads are provided on each side of the septum within the frame. The frame is designed with rounded vertical and top edges which are adapted to receive a fabric covering in the form of a sewn sock or sleeve which includes seams with inwardly formed welts adapted to be threaded into recesses in the verticals which open to the edges of the panels through a very narrow slot. The top and bottom of each vertical is provided with a removable pin, the one on the bottom also adjustably supporting the panel, which pins in turn secure plastic blocks having semi-circular gear segments, the gear teeth projecting just beyond the rounded surface of the verticals. The gear teeth extend for only slightly less than one half the height of the semi-circular face of the block. The blocks may be inverted by removing and replacing the pins. This presents the gear teeth at selected elevations to enable the formation of two, three or four way inter-panel connections. The gearing only at the same elevation will be in mesh enabling synchronous non-binding pivoting of the interconnected panels. A link through which the pins of adjacent panels extend holds the gearing in mesh. The top pin may be in the form of a clamp screw to lock the links in place. The panels, in addition to being interconnected, may be connected to walls, storage or filing cabinets, or when dividing work stations, to a power column with an ambient light serving those work stations. The power columns with panels attached form a low cost office layout.

12 Claims, 21 Drawing Figures

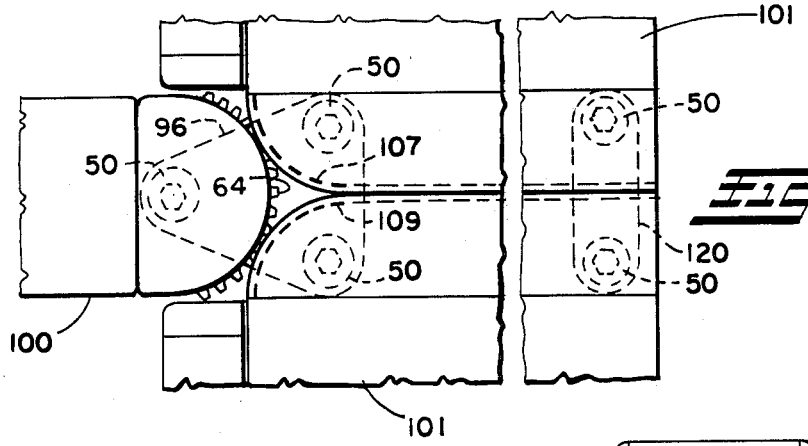
FIG. 17
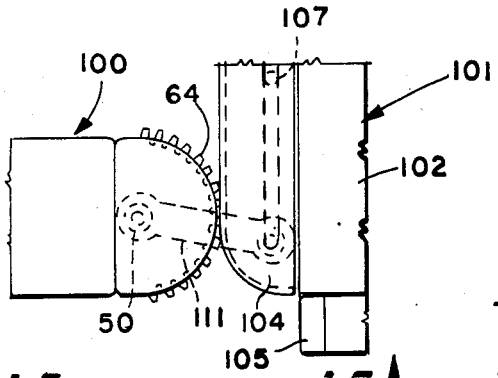
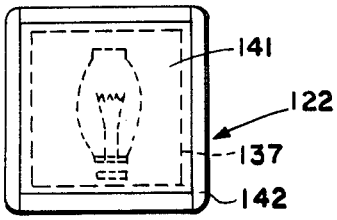
FIG. 19
FIG. 15
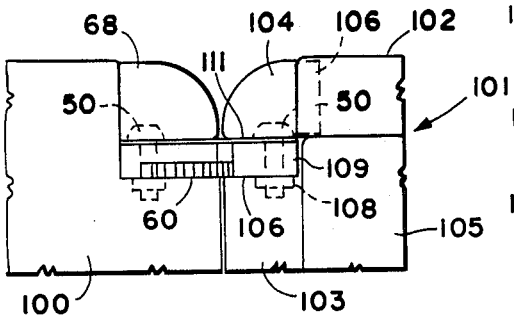
FIG. 16
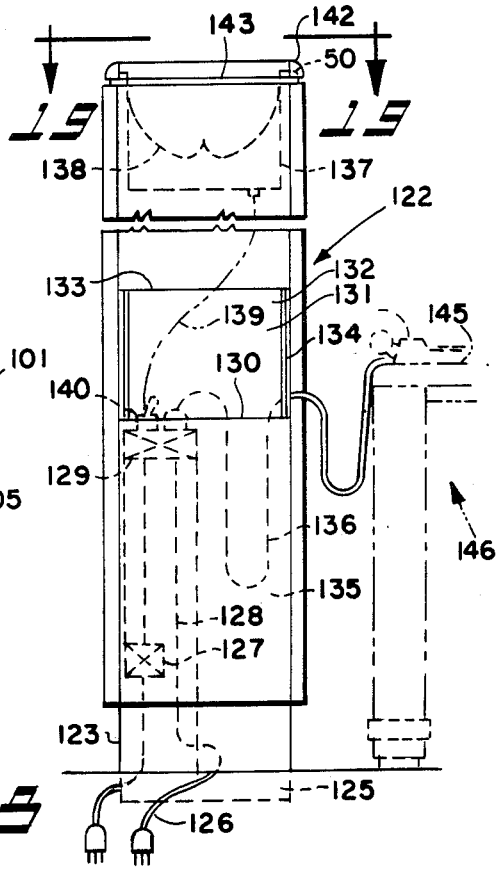
FIG. 18

SCREEN SYSTEM FOR OFFICES AND METHOD OF MAKING AND INSTALLING SAME

DISCLOSURE

This invention relates generally as indicated to a screen system for offices including a method for making, installing and adjusting the same, and more particularly to a low cost, light weight, visual and acoustical screen primarily for open interior office layouts.

BACKGROUND OF THE INVENTION

Most visual and acoustical screens for open interior office layouts are today fairly complex, fairly expensive, and fairly heavy—usually requiring for even the most minor adjustment special tools or a call to qualified maintenance personnel.

Most such screens in common use today utilize panels which are hooked into a post supporting the panels connected thereto on the floor. Even to do something as minor as slightly change the angle between adjacent panels requires complex disassembly, adjustment and reassembly procedures utilizing special tools and trained personnel. This is especially true when it is considered that the panels are normally quite heavy and cumbersome to move.

Moreover, if minor adjustments are made to such panels they tend to bind when pivoted unless completely and properly disassembled, adjusted, and then reassembled.

Some attempts have been made to alleviate this problem in folding panels and screens by providing intermeshing gearing on the tops of adjoining pivot posts. However, in such a situation, this simply further increases the complexity and cost of the system. In such a system, each panel would have its own post and interconnecting gearing simply adding to the cost and weight involved.

It is therefore desirable to have a very light weight panel which can readily be connected to adjacent panels or adjacent structures such as walls, storage or filing cabinets, or power or light columns. It is also desirable that these light weight panels may be connected quickly and conveniently and, when connected, adjusted as to angle or disposition readily without special personnel or tooling.

It is also desirable that such screens be fabric covered for both appearance as well as sound absorbing capabilities. However, to cover a panel of substantial size with fabric requires special attention to both the fabric covering, its manner of assembly with regard to the panel and the construction of the panel itself.

SUMMARY OF THE INVENTION

The present invention comprises a light weight and inexpensive sound and visual partition screen panel and method of making that panel together with a method of interconnecting such panels both in inter-panel connections and panel-to-structure connections. By structure, it is meant both permanent structures such as walls, or free-standing structures such as storage or filing cainets, or power and light columns used in connection with an array of work stations.

The panel of the present invention utilizes a treated corrugated carboard septum. The septum is resin and fire retardant treated to provide an essentially rigid yet hollow structure as the septum which has comparable properties to plywood, although in some cases superior, and yet which is a small fraction of the weight, not to mention the cost, and which provides a very superior septum for a sound or acoustical panel.

Secured to the septum is a rectangular frame of light weight extrusions such as aluminum or plastic. Acoustical insulation panels are provided on each side of the septum within the frame.

The frame is designed with rounded vertical and top edges which are adapted to receive a fabric covering in the form of a sewn sock or sleeve which includes vertical seams with inwardly formed welts. The welts and the adjacent seams are adapted to be threaded into recesses or openings in the verticals which open to the vertical edges of the panel through a very narrow slot. In this manner the sock or sleeve may be positioned over the top of the panel and properly stretched by the rounded edges when the vertical welts in the sleeve or sock are threaded into the openings or recesses in the verticals of the frame. The open end of the sleeve or sock may then readily be tacked, stapled, adhesively, or otherwise secured to the specially designed bottom frame member.

The top and bottom of each veritcal of the panel is provided with a removable pin, the one on the bottom also supporting the panel, which pins in turn secure plastic blocks having semi-circular gear segments, the gear teeth projecting just beyond the rounded surface of the verticals. The gear teeth extend for only slightly less than one-half of the height of the semi-circular face of the block so that the block may be removed and inverted by removing and replacing the pins. This presents the gear teeth at selected elevations to enable the formation of two, three or four-way inter-panel connections.

The gearing only at the same elevation will be in mesh enabling synchronous non-binding pivoting of the interconnected panels. A link through which the pins of adjacent panels extend hold the gearing in mesh, or the panels in proper relationship to the connected structure. The links, or in some cases plates, are provided wih spaced holes fitting the pins. The top pin is in the form of a clamp screw locking the links in place.

The panels, in addition to being interconnected, may be connected to walls, storage or filing cabinets, or when dividing work stations, to a power and light column serving those work stations.

In addition to providing a connection for the panels, the power column may provide at its top an ambient HID lamp. The power column may also provide power connections extending through its vertical walls at approximately work surface height adjacent a well or opening for receiving excess wiring. In addition, the permanent structure such as the wall, or the free-standing structure such as the storage or filing cabinet as well as the power column, may include in their connection for the panels, a horizontally extending rack adapted to mesh with the gearing of the panels to assist in securing and stabilizing the panels to the structures in a desired fashion.

The entire system including the panel and its method of construction as well as its method of connection and adjustment to adjacent structures forms a quickly assembled, low cost and light weight office layout.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 15 is a top plan view of a connection between a panel and a permanent or semi-permanent structure such as a storage cabinet, filing cabinet, or light column;

FIG. 16 is a vertical elevation of such connection as seen from the line 16—16 of FIG. 15;

FIG. 17 is a broken view similar to FIG. 15 on a somewhat enlarged scale illustrating a panel connected to two interconnected cabinets;

FIG. 18 is a fragmentary horizontal elevation on a reduced scale of a power column in accordance with the present invention to which panels of the present invention may be connected;

FIG. 19 is a top plan view of the power column as seen from the line 19—19 of FIG. 18;

DETAILED DESCRIPTION OF THE PREFERRED EMBODIMENTS

Figure 2:
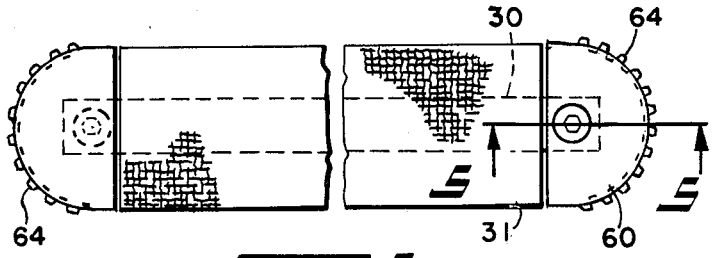
FIG. 2 is a top plan view of the panel of FIG. 1 as seen from the line 2—2 of FIG. 1.
Figure 1:
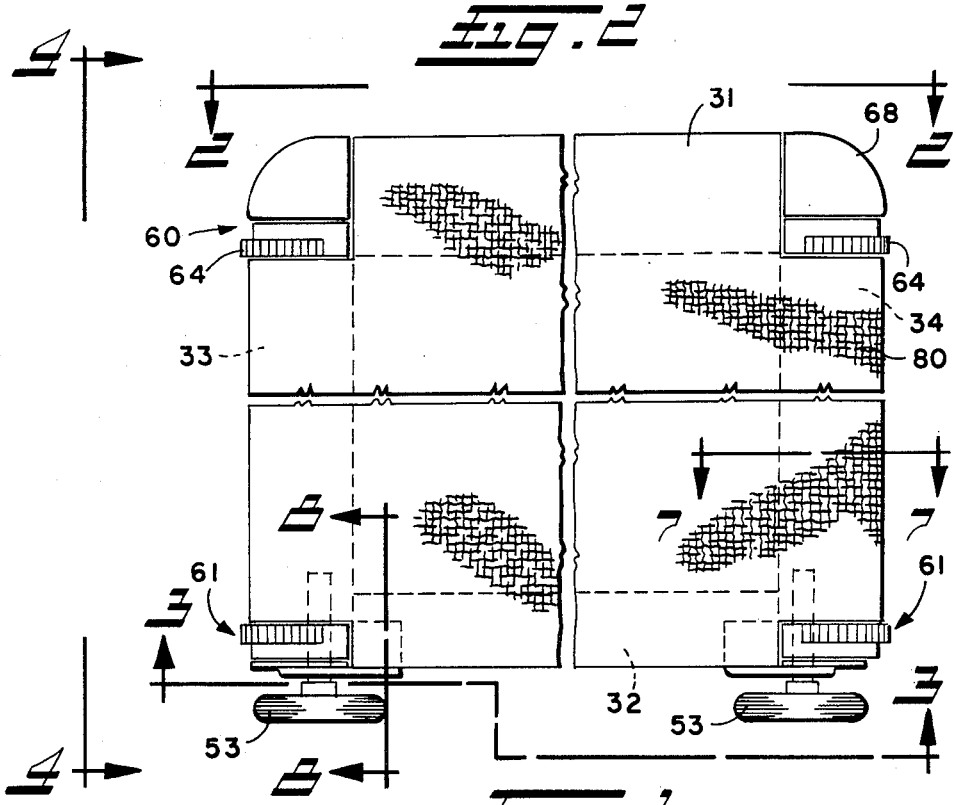
FIG. 1 is a side elevation of a panel in accordance with the present invention broken away to reduce the overall size thereof.
Figure 3:
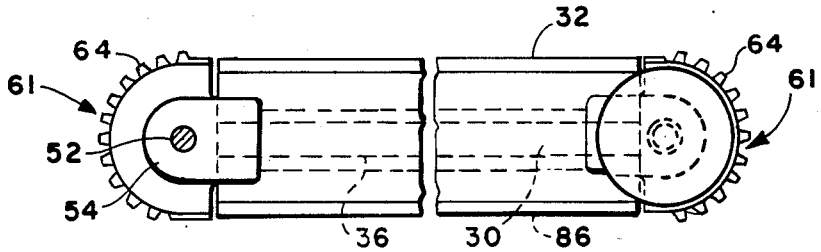
FIG. 3 is a bottom plan view as seen from the line 3—3 of FIG. 1.
Figure 4:
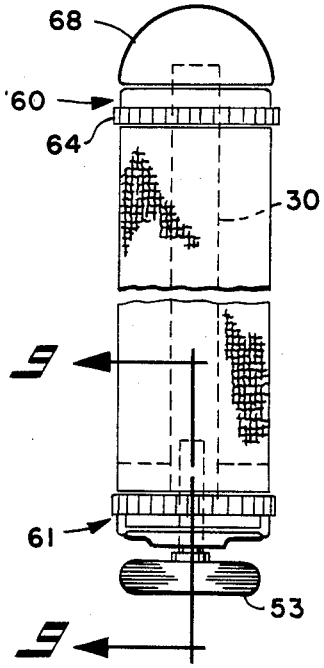
FIG. 4 is an edge elevation of the panel taken substantially on the line 4—4 of FIG. 1.

Referring first to FIGS. 1–4 it will be seen that the panel of the present invention comprises a central septum 30 which is secured to a top frame member 31, a bottom frame member 32, and verticals 33 and 34. As seen more clearly in FIGS. 5 and 8 a top rail 35 is interposed between the septum and the top frame member 31 while bottom rail 36 is interposed between the septum and bottom frame member 32. The rails are in the form of a channel shape members which enclose the top and bottom edges of the septum, respectively, and fit within interior channels in the respective top and bottom frames 31 and 32. As seen more clearly in FIGS. 5 and 9, the bottom and top rails at each end include an inverted F-shape bracket at the ends thereof as seen at 40 and 41. Each F-shape bracket includes a bottom leg as seen at 42 and 43, respectively. Secured as by welding to the vertical leg of the bracket is a top plate or clasp as seen at 44 and 45 each of which includes central detents seen at 46 and 47. The top rail assembly bracket 41 has a weld nut secured to the underside of the leg 42 as seen at 49 in FIG. 5 and aligned holes are provided in the brackets parts 44 and 42 to accommodate a pin or screw fastener 50.

The bracket parts 43 and 45 of the bottom rail bracket 41 are also provided with aligned holes to accommodate the threaded shank 52 of adjustable glide 53. The shank is threaded in leveler assembly 54 as indicated at 55 and such leveler assembly includes an interior upwardly opening U-shape portion 56 which snaps on to the bottom frame as seen more clearly in FIG. 8. The bracket parts at the end of each top and bottom rail are constructed to receive respective interchangeable top and bottom plastic gear blocks shown generally at 60 and 61 at each end of the panel. With the fastener 50 or threaded shank 52 removed, the gears 60 or 61 may readily be removed and replaced by simply snapping them out of and into the interposed bracket parts. A recess indicated a 62 in both the top and bottom face of the gear will engage the detent 47 or 46 when the gear is properly in place. The fastener or threaded shank may simply then be reinserted. Each gear of course has a hole accommodating the fastener or threaded shank, as well as top and bottom recesses accommodating the bracket legs. It should also be noted that the bottom gear may be removed and replaced without completely unthreading the shank 52 simply by snapping the leveler assembly from the bottom extrusion.

Each gear is in the form of a block which has a semi-circular, outwardly directed face starting from a diameter which extends through the hole acommodating the pin. The semi-circular face includes two distinct vertically separated sections, namely a section 64 with projecting gear teeth and a semi-circular section 65 with no projecting gear teeth. The height of the gear teeth 64 is slightly less than half the height of the block. In this manner by removing, inverting, and replacing, the elevation of the gear tooth section 64 may be altered.

Figure 5:
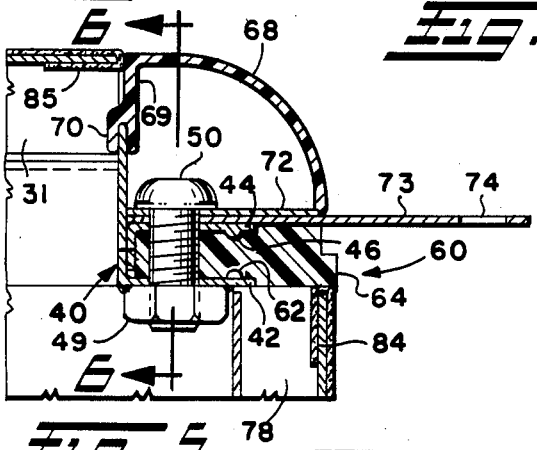
FIG. 5 is a fragmentary vertical section through the assembly at the top of a vertical as seen from he line 5—5 of FIG. 2.
Figure 6:
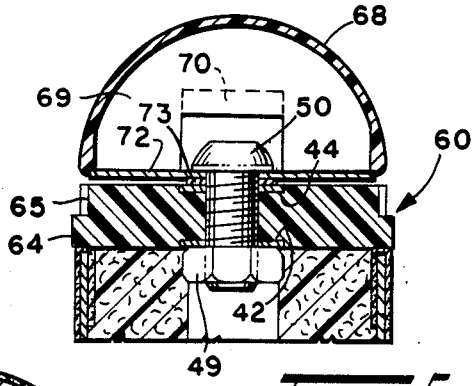
FIG. 6 is a similar transverse section through the assembly at the top of a vertical as seen from the line 6—6 of FIG. 5.

Referring now to FIGS. 5 and 6 it will be seen that the fastener 50 may be removed by removing cap 68 which is in the form of a half dome having a circular vertical edge and a circular horizontal edge corresponding to the semi-circular configuration of the top frame 31 and the verticals 33 and 34. As indicated in FIG. 5 the caps include an interior wall 69 which includes a cut-out accommodating the top leg of the bracket 40 and which includes along the top edge of that cut-out a slotted or clevis portion 70 which snugly fits over the top edge of the rail bracket. In this manner the cap can readily be removed and replaced.

Figure 9:
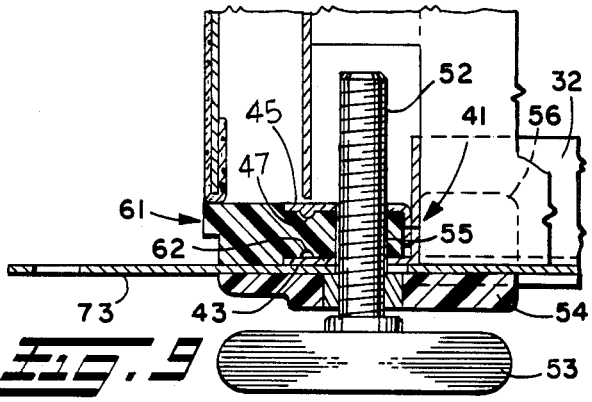
FIG. 9 is a view taken from the line 9—9 of FIG. 4.

The bottom edge of the cap includes an inner corner recess accommodating the edge of spacer clamp plate 72. A link or lock plate 73 used when securing panels together or to other structures extends between the clamp plate 72 and the top of gear 60. In a normal two-way connection the link is relatively narrow and includes holes at each end as seen at 74 accommodating the respective fasteners 50 on the connected panels. The bottom link seen in FIG. 9 is secured between the leveler assembly 54 and the gear 61 held by the bracket on the end of the bottom rail.

Figure 7:
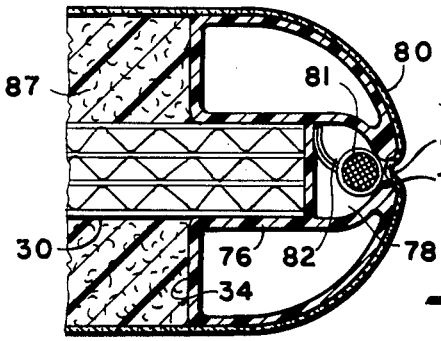
FIG. 7 is a similar horizontal section taken through a vertical as seen more clearly from the line 7—7 of FIG. 1.

Referring now to FIG. 7 it will be seen that the vertical frame members at each end of the panel may be in the form of an extrusion and include interior channels 76 adapted directly to receive the vertical edge of the septum. The septum may be secured in such channels by gluing. The vertical frame members also include an interior recess semi-circular in form indicated at 78 which opens outwardly to a quite narrow slot 79 along the vertical edge of the panel. The narrow slot opening along the vertical edge has rounded edges. The configuration of the recess and the slot 79 permits a fabric sock or sleeve 80 to be prefabricated with interior welts 81 running the entire vertical length of the sock or sleeve at each side. The welts may be sewn to the sock or sleeve on both sides thereof as indicated at 82 and 83. In this manner in assembling the prefabricated sock or sleeve over the panel, the welts are threaded through the tops of the recesses 78 and the configuration of the verticals uniformly stretches the fabric. Loose edges of the fabric cover are simply tucked around the frame ends as seen at 84 and 85 and glued into place. The bottom edge of the cover may be fastened to the interior of the frame 32 or secured around the bulb edges 86 thereof by one or more suitable clips, not shown.

Figure 8:
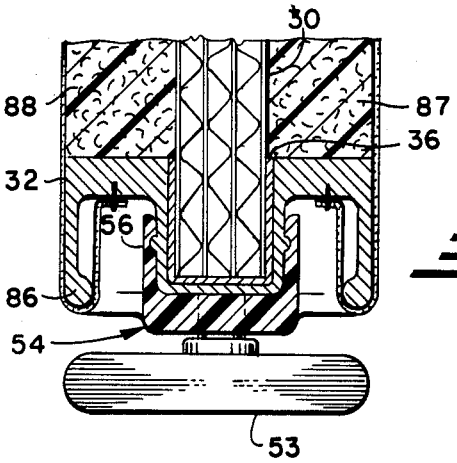
FIG. 8 is a similar vertical section through the bottom frame member as taken from the line 8—8 of FIG. 1.

Also as seen more clearly in FIGS. 7 and 8, the septum 30 is in the form of a three-ply corrugated cardboard sheet. The sheet is approximately the same thickness as plywood and by impregnating the sheet with certain resin and fire retardants, a very light weight and acceptable septum is provided. The septum is a small fraction of the weight of plywood and serves much more readily as a structural and sound attenuating panel septum. Sound insulation padding such as formed from glass fibers is positioned on each side of the septum as indicated at 87 and 88 with the fabric covering 80 being positioned directly thereover.

The septum is notched at its corners to accommodate the pins or weld nuts. Accordingly, as will become apparent, when screen panels are series connected or to another structure, they are not connected through the verticals, or the septum, but only through the horizontal top and bottom rails. There is no force in the longitudinal direction of the screen on these elements.

As noted more clearly in FIG. 2, the teeth 64 of the gearing project slightly beyond the rounded edge of the vertical frame members and such teeth are designed to mesh with the teeth on corresponding gears of adjacent panels in certain connections.

Figure 10:
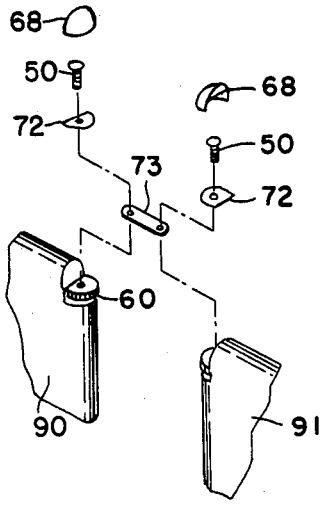
FIG. 10 is a broken schematic perspective and exploded illustration of a two-way panel connection at the top of the panel.
Figure 12:
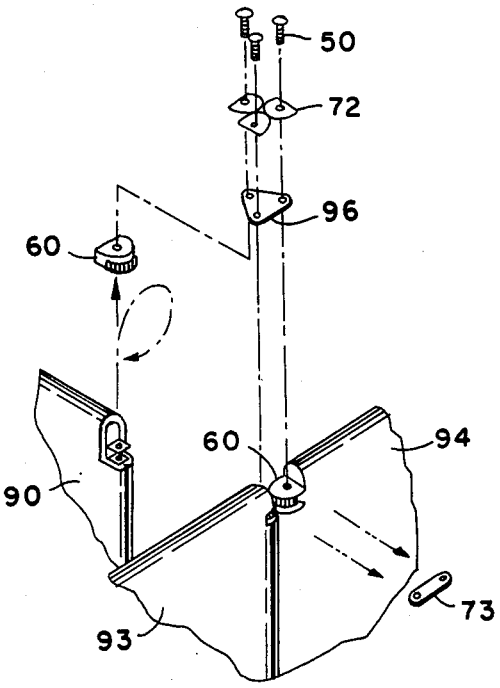
FIG. 12 is a similar broken and exploded perspective view of a three-way panel interconnection.
Figure 11:
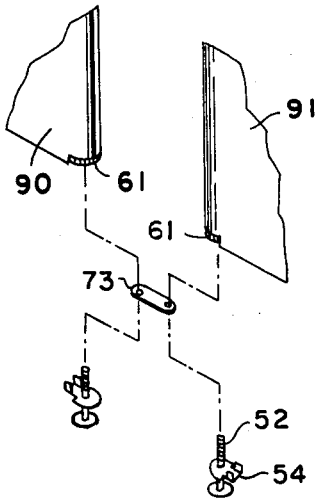
FIG. 11 is a similar view showing the bottom of the panel.
Figure 13:
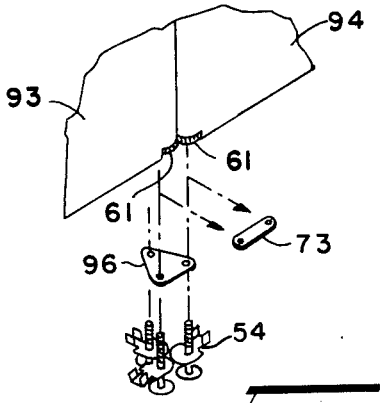
FIG. 13 is a similar view taken from the bottom of the three-way connection.

Referring now to FIGS. 10 and 11 there is illustrated a standard end-to-end panel connection. A panel would normally be shipped with the caps, spacer, clamp plate, screw, gears and leveler in place with the gears having their teeth in an "engaged" position. Then, to make a standard connection as seen in FIGS. 10 and 11, the cap 68, screw 50 and spacer or clamp plate 72 is removed on each of two adjoining panels 90 and 91. The same is true at the bottom of the adjacent panels in that the snap-in leveler assemblies 52 are removed. With the parts disassembled as indicated, the two-way link or lock plates 73 are then inserted and the parts reassembled with the respective gears 60 at the top and the respective gears 61 at the bottom in mesh. The panel may then be hinged at substantially any angle without binding. The spacing of the holes ensures proper meshing of the gears. Normally the hinge angle will be selected and then the top link 73 would be clamped tight.

Figure 14:
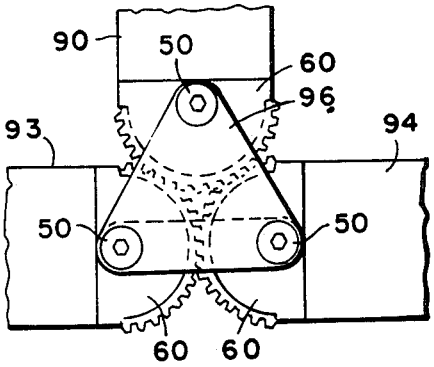
FIG. 14 is a somewhat enlarged top plan view of the three-way connection.

Referring now to FIGS. 12–16, there is illustrated a typical thee-way connection. In order to form the illustrated three-way connection the gear blocks 60 and 61 of the panel 90 are removed and inverted to change the elevation of the gear teeth so that they will not mesh or engage with the gear teeth 64 of the gears 60 and 61 of the panels 93 an 94. With the gear block 60 inverted the gear teeth 64 will be at an elevation different from that of the adjoining adjacent panels 93 and 94. Thus to add a third or fourth panel to the joint the parts are removed as in the standard two-way connection. The gear 60 of the panel 90 is unsnapped and flipped over to the "disengaged" position. The connection is then reassembled substituting a three-way or four-way link or lock plate indicated at 96 for the two-way link which is removed. Thus as seen in FIG. 14, the gear teeth 64 on the end of panel 90 are not at the same elevation nor are they in mesh with the gear teeth on the ends of panels 93 and 94. Only the gear teeth on the ends of panels 93 and 94 are in mesh. In the event of a four-way connection the gear on the end of the panel opposite the panel 90 would also be in the disengaged position not in mesh with the gears on the ends of panels 93 and 94. No disassembly or reassembly is required on the end-of-run panels and it will also be appreciated that on such panels at their ends, glides having laterally extending feet may be provided.

Referring now to FIGS. 15 and 16, it will be seen that panels of the present invention may be secured to permanent or free-standing structures such as walls, filing or storage cabinets, or light or power columns, as later described. In FIG. 15 it will be seen that a panel 100 may readily be connected to a storage or filing cabinet 101. The panel 100 is in all respects the same as the panels previously described. The cabinet 101 may include a top panel 102 and a side panel 103. The side panels may be on either side or the back of the cabinet and a removable cap 104 extends along the tops of the side panels. The front of the cabinet or storage unit may be provided with drawer faces indicated at 105. The removable caps 104 may simply plug into the top panel as indicated at 106 in FIG. 16 or be otherwise secured in place.

The side panel is firmly secured to the storage cabinet and includes a top wall 106 which may be provided with a series of vertical holes 107 which may be on approximately 50 mm. centers beneath each of which are secured weld nuts 108. Alternatively, a T-slot indicated in phantom lines may be provided with a threaded sliding clamp nut or fitting. Projecting upwardly from the plate 106 is a vertically extending, slightly recessed plate 109 which provides a recess or clearance area for the teeth of gears 60 on the connected panel. There is a slight gap between the top of the recessed plate 109 and the removable cap 104 to provide clearance for link 111 which may be used to clamp and secure the panel to the cabinet 101. At the bottom of the cabinet, the side panel may simply be recessed above the floor with a horizontal plate having holes 107 on the same centers as the top plate 106, or a similar T-slot with a snap-in fitting. Such holes may be adapted to receive snap-in pins to secure without necessarily clamping the bottoms connecting links or plates. In this manner with similar links or plates the bottoms of the panel may also be secured to the structure 101 in similar fashion.

Referring now to FIG. 17 it will be seen that two cabinets 101 may be interconnected and connected to a panel 100 by a three-way link 96. In each case the fasteners 50 will be the same and the gearing 64 of the plastic lock gear 60 will fit into the recess formed by the curved end portions of the recessed plates 109. As indicated, the two cabinets may additionally be interconnected by links 120. Such links may have holes at each end of the same size and such holes are spaced the same as the holes on the short leg of the triangular plat 96. In this manner the interconnected cabinets, light columns or panels synergistically support and stabilize each other.

Referring now to FIGS. 18 and 19, there is illustrated a power or light column 122. The light column or power tower may be primarily a sheet metal housing structure which includes a telescoping adjustable base 123 which opens through to the floor of subflooring wiring as indicated at 125. One or more relatively short power leads 126 connect to or through a remote ballast 127 which leads vertically through power riser 128 to face up convenience outlets 129. The outlets are positioned just below the lower edge 130 of openings 131 in each of the four walls of the column. The openings may be closed by hinged covers or closures 132 which are hinged at the top 133 and which may include a magnetic or similar type latch at the bottoms. The closures at each adjacent vertical edge include flexible strips 134 through which wiring, as indicated, may extend at any level therealong.

Adjacent the power riser 128 is a wire dump or open area 135 within the housing into which excess wiring may be positioned as indicated at 136. Positioned in the top of the column is an ambient light indicated at 137 which is preferably of the HID (high intensity discharge) type. The lamp includes a reflector 138 and is wired to the remote ballast 127 through lead 139 which extends through switch 140 on the convenience outlet box 129. Preferably the top of the lamp is covered by a glass or diffuser 141.

At the top of the power column there is provided a removable trim ring 142 which, when removed, exposes fasteners 50 in the same manner as in connection with the storage or filing cabinets. A recessed vertical plate 143 extends around the top of the power column providing a recessed area accommodating the gears of adjacent and connected panels. It will be appreciated that the top of the light column may also be provided with a glare shield and maybe provide with a fabric cover for better sound absorption. The openings 131 are positioned horizontally within a range of vertical adjustment of a work surface seen at 145 of work station 146. Such work station may be of the type shown in the copending application of Neils Diffrient filed even date herewith entitled "Work Station".

It is noted that the power tower is provided with at least two "pigtails" or leads 126. One would normally be for lighting and the other for power. However, there obviously may be several more with dedicated receptacles in the convenience outlet to such things as communications or computer interface wiring connections.

Figure 20:
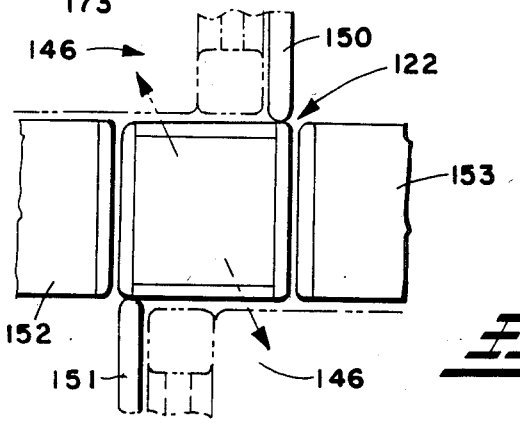
FIG. 20 is a top plan view of the power column in accordance with the present invention illustrating a power column arrangement with panels of the present invention connected for a certain office layout.

Such work stations may themselves incorporate wiring channels or wiring trays and as seen in FIG. 20 the wiring may pass directly from the light column 122 into the special channels or trays provided in such work stations. FIG. 20 illustrates a typical layout positioned around a light column 122. Panels 150 and 151 are connected to the light column at opposite corners and extend in opposite directions. Cabinets 152 and 153 may also be connected to the power column or light column 122 in the manner previously described.

Figure 21:
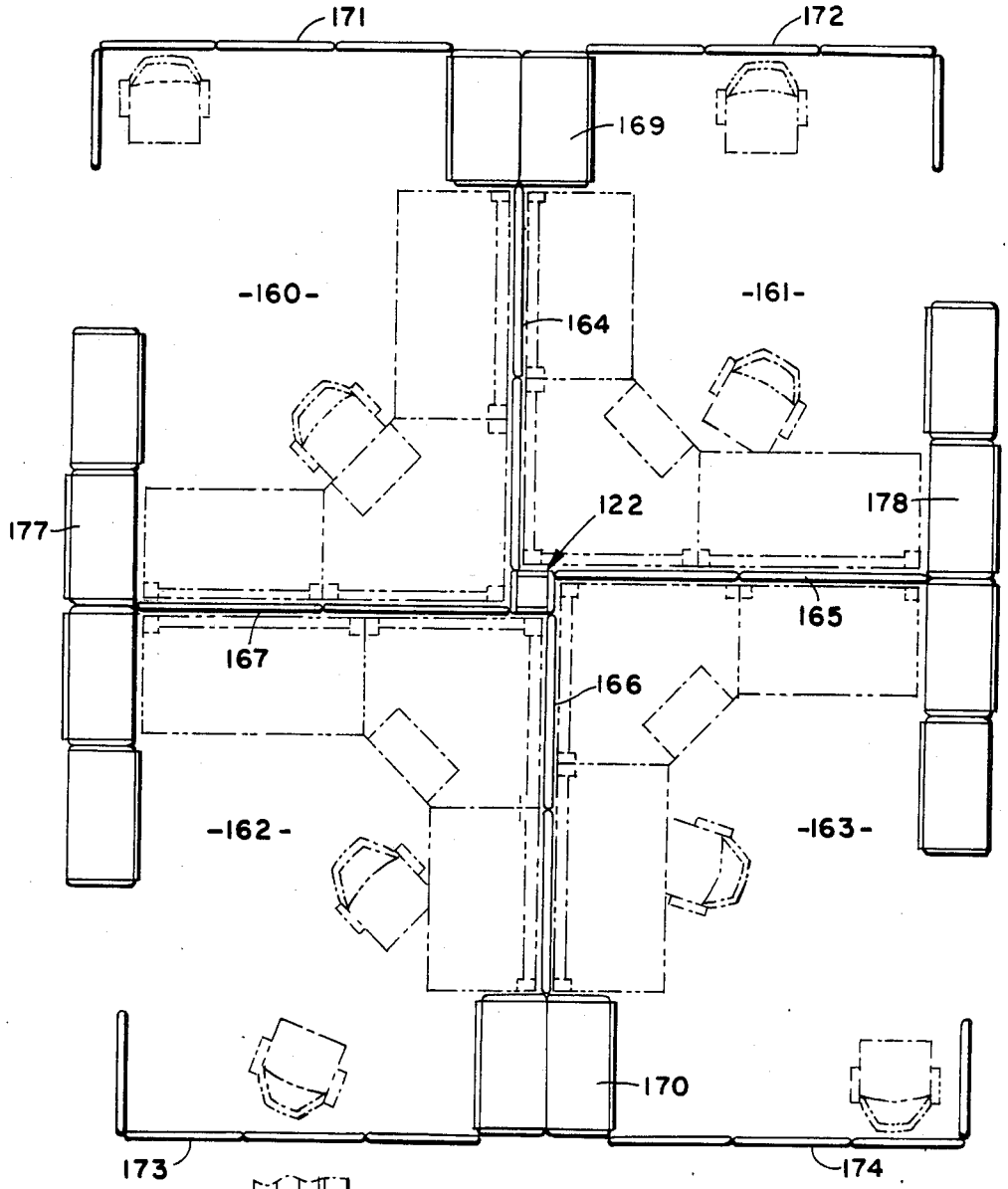
FIG. 21 is an illustration of an office layout in accordance with the present invention showing panels connected to the power column as well as filing or storage cabinets.

Referring now to FIG. 21 there is illustrated a typical office layout providing four separate offices or work stations seen at 160, 161, 162 and 163. Each of the partitioning components, whether they be cabinets, power columns or panels, may be physically interconnected to each other in the manner previously described. It will be seen that in the center of the layout is provided a power or light column 122 with interconnected panel runs 164, 165, 166 and 167 extending radially therefrom and connected to the light or power column at its corners. Back-to-back cabinets, themselves interconnected, are connected to the panel runs 164 and 166 as shown at 169 and 170, respectively. From such back-to-back cabinets there is connected a series of panels seen at 171, 172, 173 and 174 forming an enclosing screen for the work stations 160–163, respectively.

The panel runs 167 and 165 may be connected to interconnected cabinets seen at 177 and 178 which also partially enclose the respective work stations.

It will also be appreciated that the panels of the present invention may be connected to more permanent structures such as walls simply by fastening to the wall at the proper height a projecting bar or structure through which the clamp fasteners may be positioned and locked. It will also be appreciated that the recessed gear area provided on the cabinets and light columns may itself be provided with a rack designed to mesh with the gear teeth on the panels. Again, the teeth of the rack would extend only slightly less than half the height of the recessed area so that the teeth of the panel and rack may be engaged optionally by changing the elevation of the teeth on the panel by inversion of the gear segment.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. An interior office sound and visual screen having a central septum including top and bottom frame members, semi-circular extrusions secured at the top and vertical edges of said septum, said semi-circular extrusions being wider than the septum, semi-circular gears at the top and bottom of the vertical edge semi-circular extrusions, means to secure said gears to the septum, and half-dome covers for the gears at the top of the vertical edge semi-circular extrusions, said half-dome covers filling the upper corners of the screen between the vertical extrusions and forming a generally rounded corner surface continuation of the semi-circular extrusions.

2. An interior office screen as set forth in claim 1 including sound absorbing material extending to the width of said extrusions on each side of said septum, and a fabric cover on said screen.

3. An interior office screen as set forth in claim 2 wherein each extrusion includes a slot at the center of its semi-cylindrical surface adapted to receive, secure and conceal an edge of said fabric cover.

4. An interior office screen as set forth in claim 1 wherein the teeth of said gears project just beyond said semi-circular extrusions and are adapted to mate with corresponding gears on adjacent screens, and removable link means adapted to be secured to said screen and interconnecting adjacent screens to hold said gears in meshing engagement.

5. An interior office screen as set forth in claim 4 wherein said removable link means includes a link extending between the centers of said meshing gears.

6. An interior office screen as set forth in claim 5 wherein said removable link means at the top of each screen extends between the top of the gear and the respective half-dome cover.

7. An interior office sceen as set forth in claim 6 wherein said link means are secured by a fastener, and said half-dome covers are plastic and include a snap-on, snap-off connection to the screen to conceal and expose such fastener.

8. A screen comprising a frame including verticals having semi-circular outwardly directed edges, and fastening means for securing the screen to an adjacent structure alternately fixed in one of a plurality of angular relationships with an adjacent structure or angularly movable with respect to an adjacent structure, the fastening means including link means projecting from the screen and pivotable about the axis of the semi-circular edges of the vertical for positioning the screen a fixed distance from an adjacent structure, a gear segment having teeth extending radially outward beyond the semi-circular edges of the vertical of the screen and adapted to engage with corresponding teeth on an adjacent structure, and means for positioning the gear segment in a selected one of two vertical positions in the first of which the teeth of the gear segment are coplanar with and engage corresponding teeth of an adjacent structure thereby to fix the angular relationship of the screen with an adjacent structure and in the second of which vertical positions the teeth of the gear segment are free of engagement with corresponding teeth of an adjacent structure.

9. The screen of claim 8 wherein the adjacent structure is another one of said screens.

10. The screen of claim 8 having a removable pin coaxial with the semi-circular edges of the vertical connecting the link means with the screen.

11. The screen of claim 10 wherein the pin extends through the gear segment.

12. The screen of claim 10 wherein the gear segment includes a hub and a toothed portion, the toothed portion extending vertically less than one-half the vertical extent of the hub, and the means for positioning the gear segment includes mneans for inverting the gear segment.

* * * * *